United States Patent [19]

Prevatt

[11] Patent Number: 5,042,552

[45] Date of Patent: Aug. 27, 1991

[54] SECURITY SHUTTER LOCKING SYSTEM

[76] Inventor: Robert R. Prevatt, 9444 Janice La., Largo, Fla. 34643

[21] Appl. No.: 422,756

[22] Filed: Oct. 16, 1989

[51] Int. Cl.[5] ..... E06B 3/48

[52] U.S. Cl. ..... 160/118; 160/199

[58] Field of Search ..... 160/118, 199, 206, 196.1; 292/DIG. 21, 38

[56] References Cited

U.S. PATENT DOCUMENTS 2,577,884 11/1951 Garubo ..... 160/206 X 4,799,528 1/1989 Benitez ..... 160/199

*Primary Examiner*—Blair M. Johnson

[57] ABSTRACT

An obstruction device for the purpose of securing a hatch or window opening from the interior on a room, using shutter slats hingedly mounted and vertically hung to the track on the inside edge of the shutter frame; horizontal members are fixed to the back of the frame near the top and bottom, and continuous from one side to the other to obstruct the shutters from swinging outwardly: the shutter frame is slotted continuously from one side of the frame to the other side and along a small portion of the inside edge in the four corners in the top and bottom: top and bottom horizontal sliding members are fitted into the said top and bottom sliding spaces and extend into slots of opposing corners so as to allow them to slide up and down in said slotted spaces but remain in the slots in opposing corners: Strong flexible straps attached to both ends of a bottom horizontal sliding member, are routed up over the rounded ends of spacer blocks and down the other side where it is attached to the ends of vertical sliding members; said vertical sliding members extend within vertical hollow spaces in both sides of the frame from the bottom of the frame to the top horizontal sliding member where they are firmly attached. When the shutter slats are extended to close the opening, and the top and bottom horizontal sliding members are in the obstructive locking position, a locking pin is inserted through either or both sides of the shutter frame to penetrate the vertical sliding members.

1 Claim, 6 Drawing Sheets

SECURITY SHUTTER LOCKING SYSTEM

BACKGROUND OF THE INVENTION

In may construction business, I have noticed an increase in the use of interior shutters, but there is not one that has a security locking system adequate to repel an attempted break-in. This is primarily because of shutter design and inherent weakness of the hinged connections used in all currently produced shutter locking systems.

It was my intention to make a locking system for shutters that would be extremely strong, easy to operate, and operatable from the inside of the building.

After hours of research and experimentation, this was accomplished by building a frame in such a way that it will allow a horizontal member from inside the frame at the bottom to be slid up over the bottom of the vertical shutters simultaneously causing a top horizontal member to slide down out of the frame and over the top ends of the vertical shutter when the shutters are in a closed position. These horizontal sliding members serve the purpose of keeping the shutters from being pushed toward the inside of a building. On the opposite side of the shutter, horizontal members are permanently attached at the top and bottom of the opening to prevent the shutters from being pulled toward the outside of a building. A locking pin is inserted through the side of the frame and into one of the sliding vertical members to create an obstruction to the moving parts connected to the top and bottom horizontal sliding members to prevent them from being jimmied open when in the locked position.

SUMMARY OF THE INVENTION

Briefly stated, the invention contemplates the provisions of an improved locking system for vertical shutters. The locking system is built into the frame which houses the shutters. Fixed top and bottom horizontal members will create an obstruction on one side of the shutters. Top and bottom horizontal sliding members concealed within the frame, will be manually operated to obstruct the interior face side of the shutter. The purpose for the horizontal members at the top and bottom of both sides of the shutters, is to bear the pressure of an intruder trying to push the shutters in or pull the shutters out. When the shutters are locked, they will be completely blocked on both sides and at the top and bottom ends to prevent an intruder from moving the shutters from side to side or up and down.

A locking pin inserted through the side of the frame and into a sliding side member, will obstruct the movement of the top and bottom horizontal sliding member, preventing an intruder from using a tool to jimmy the shutters open.

BRIEF DESCRIPTION OF THE DRAWINGS

In the drawings, to which reference will be made in the specifications, similar reference characters have been employed to designate corresponding parts throughout several views.

FIG. 3 is a rear elevation view there of.

SECURITY SHUTTER SYSTEM

Figure 1:
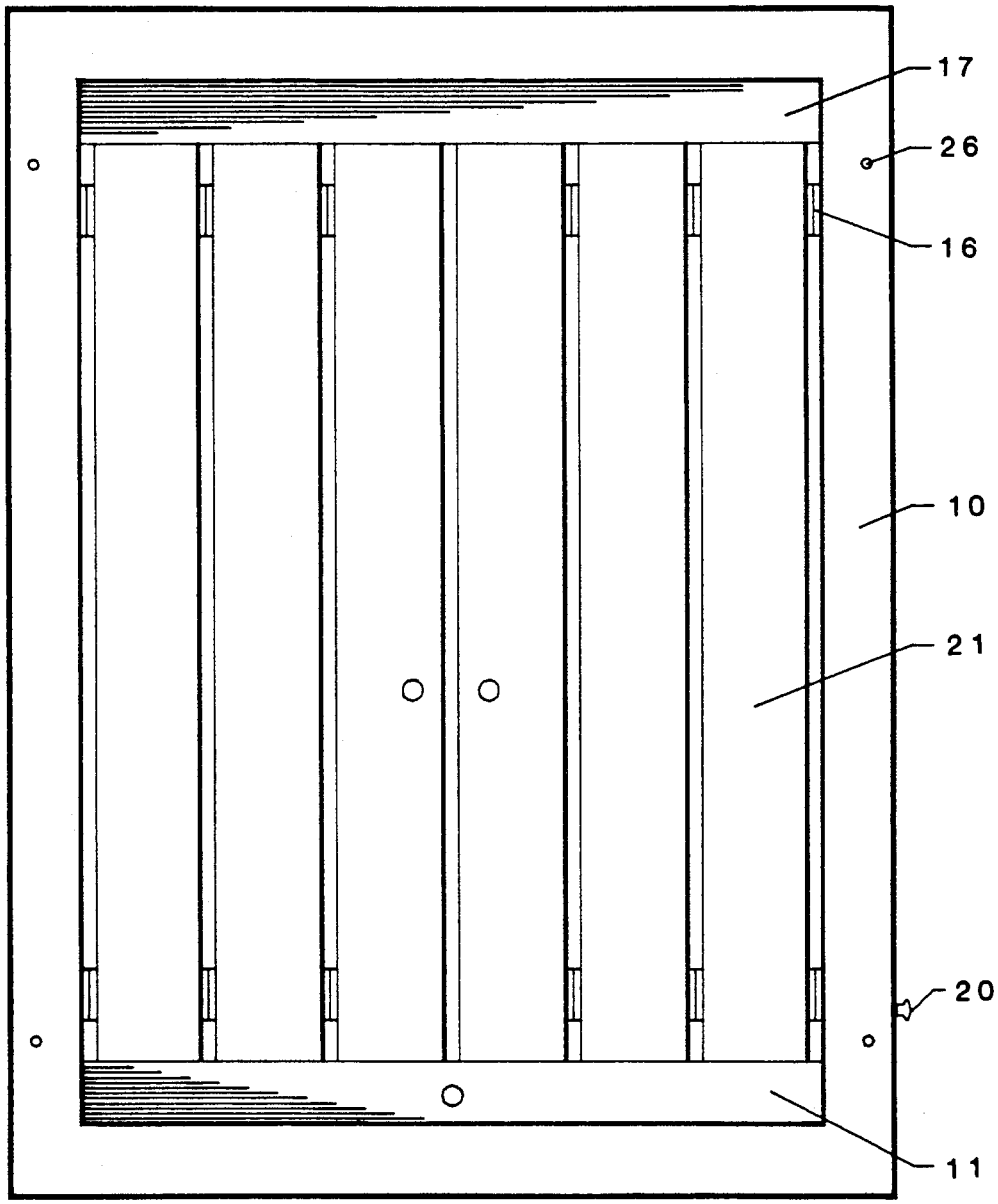
FIG. 1 is a front elevation view of a security window shutter embodying the invention in a closed position.
Figure 2:
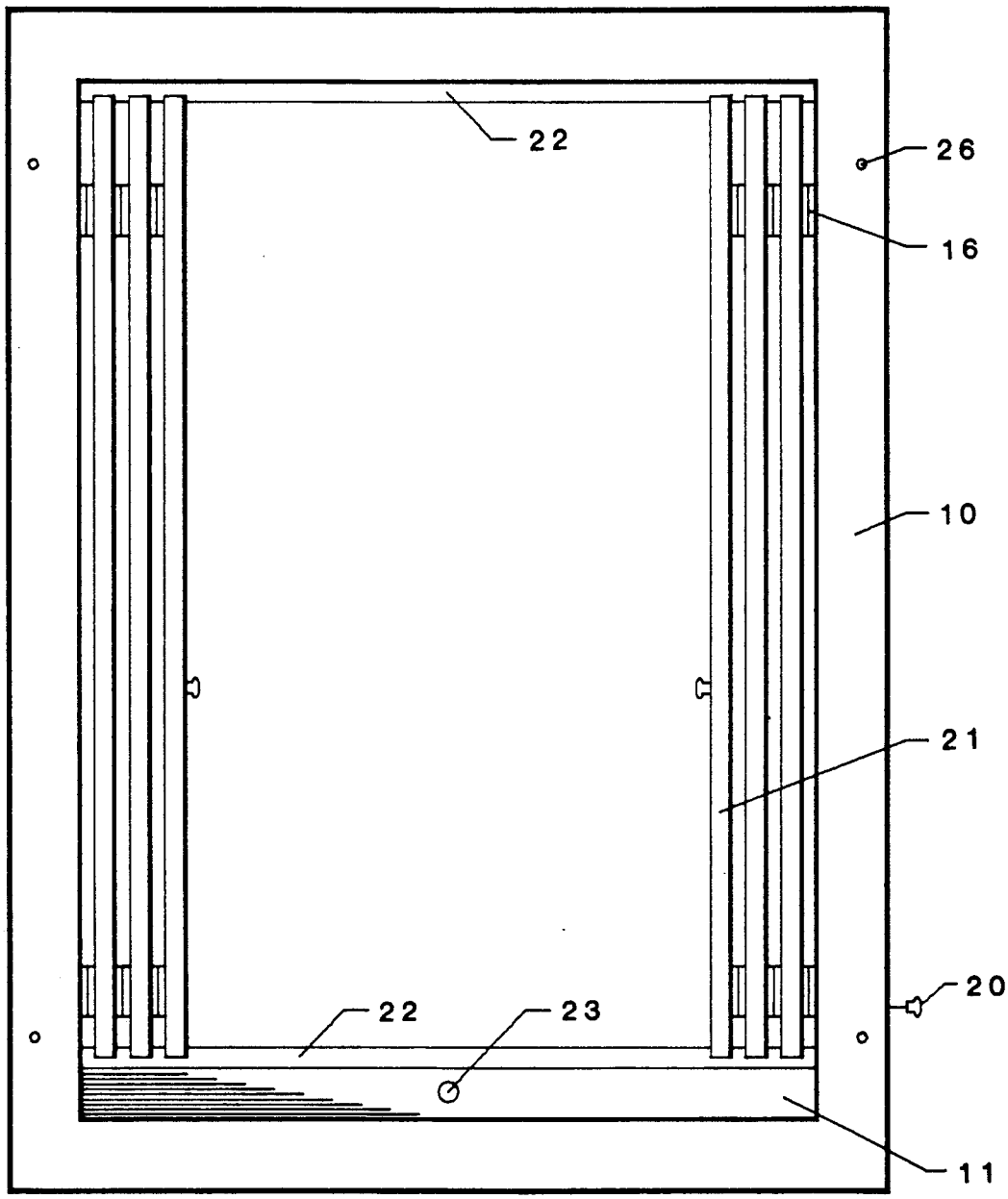
FIG. 2 is a front elevation view of the security window shutter embodying the invention in an open position.
Figure 3:
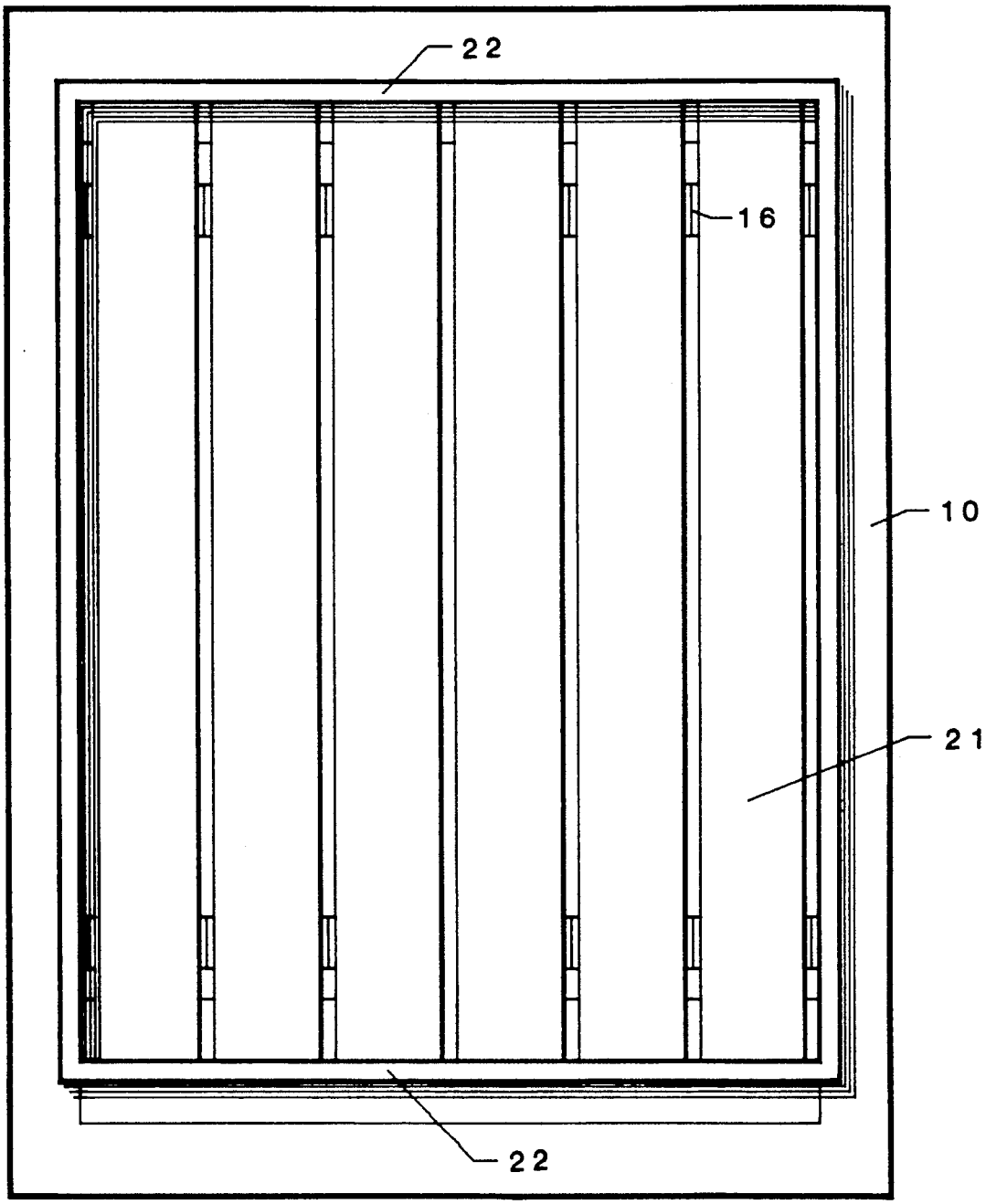
Figure 4:
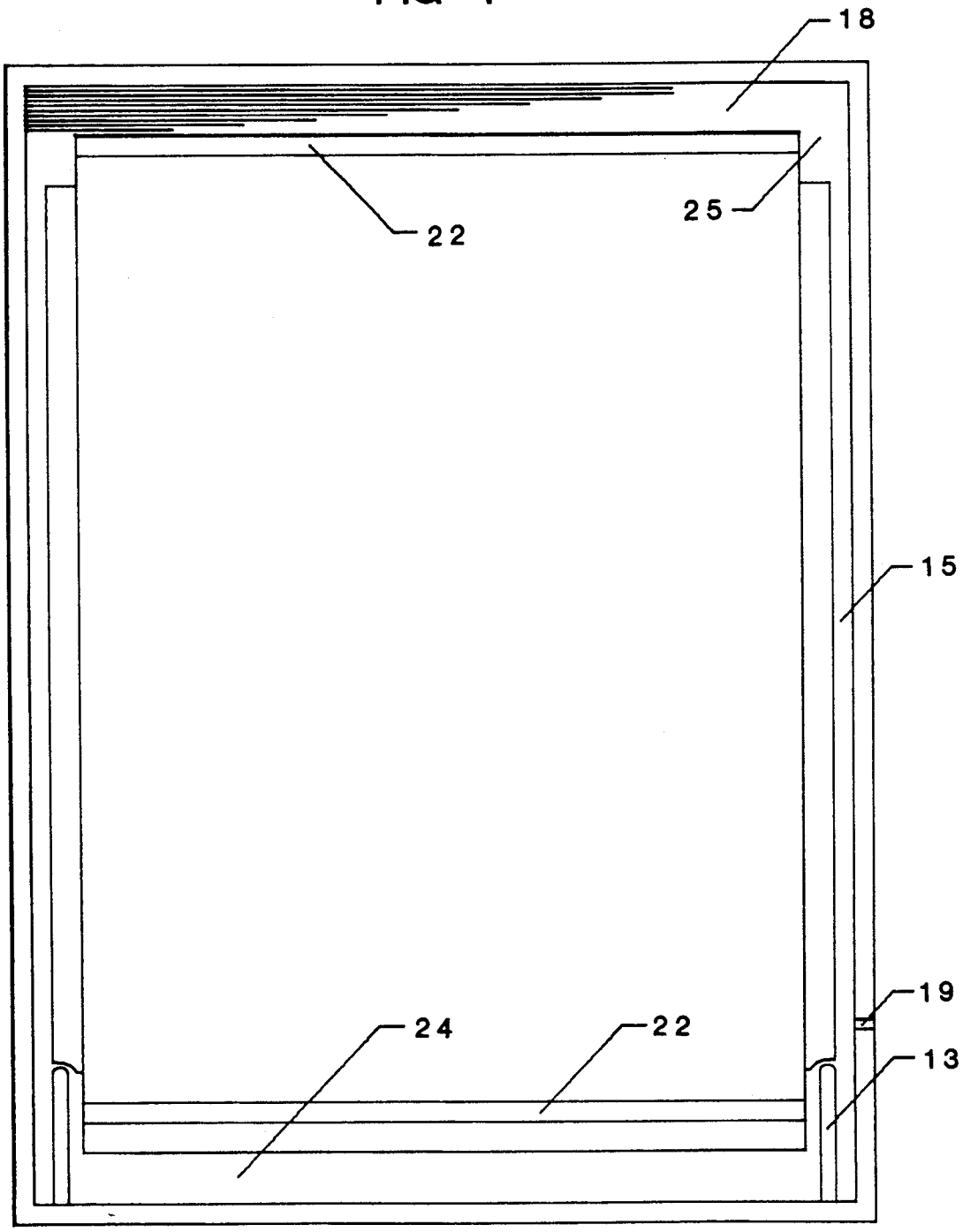
FIG. 4 is an interior view of the security shutter frame.
Figure 5:
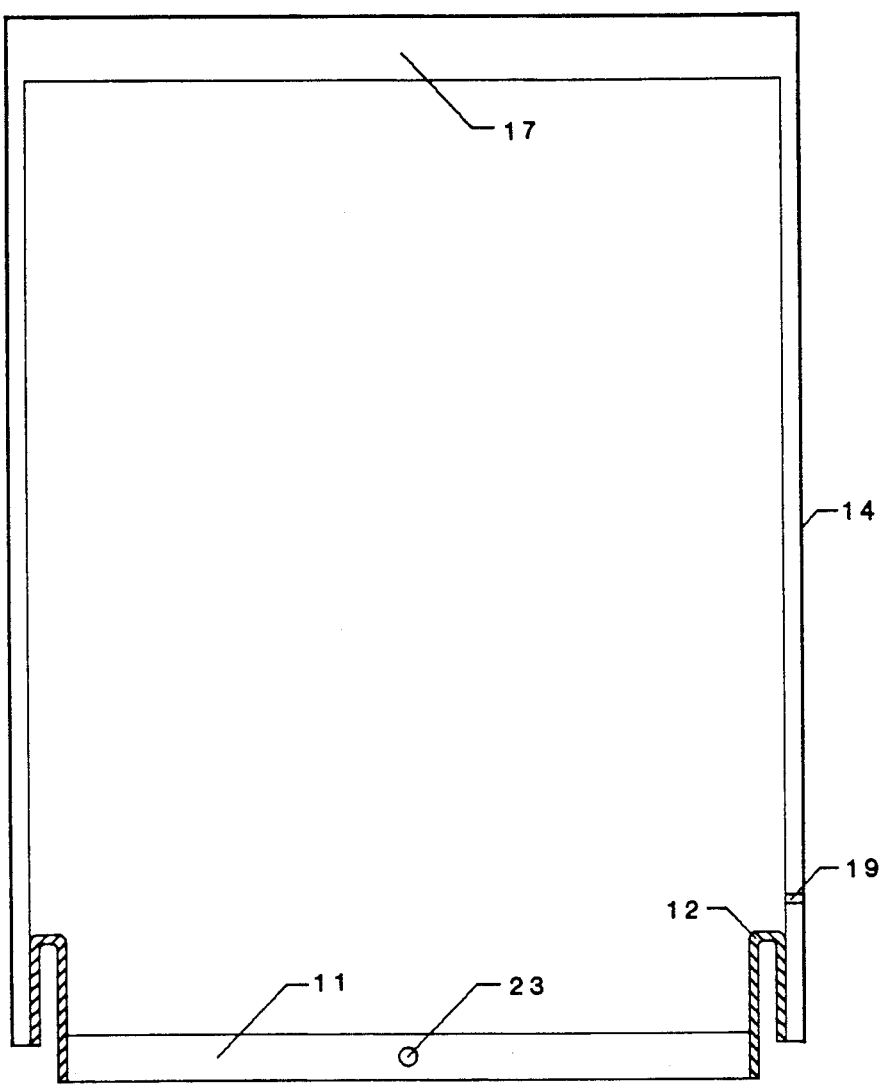
FIG. 5 is a view of the sliding member.
Figure 6:
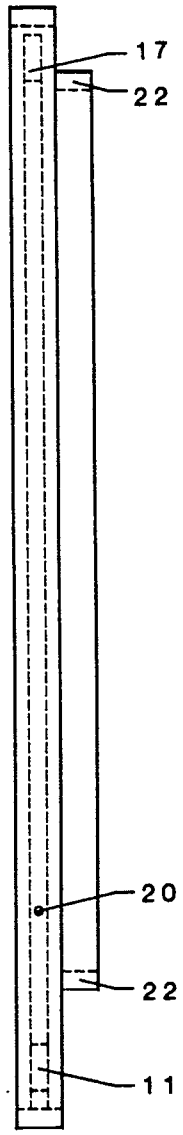
FIG. 6 is a vertical side view.
Figure 7:
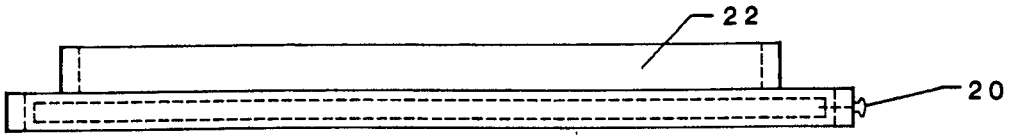
FIG. 7 is a horizontal top view.
Figure 8:
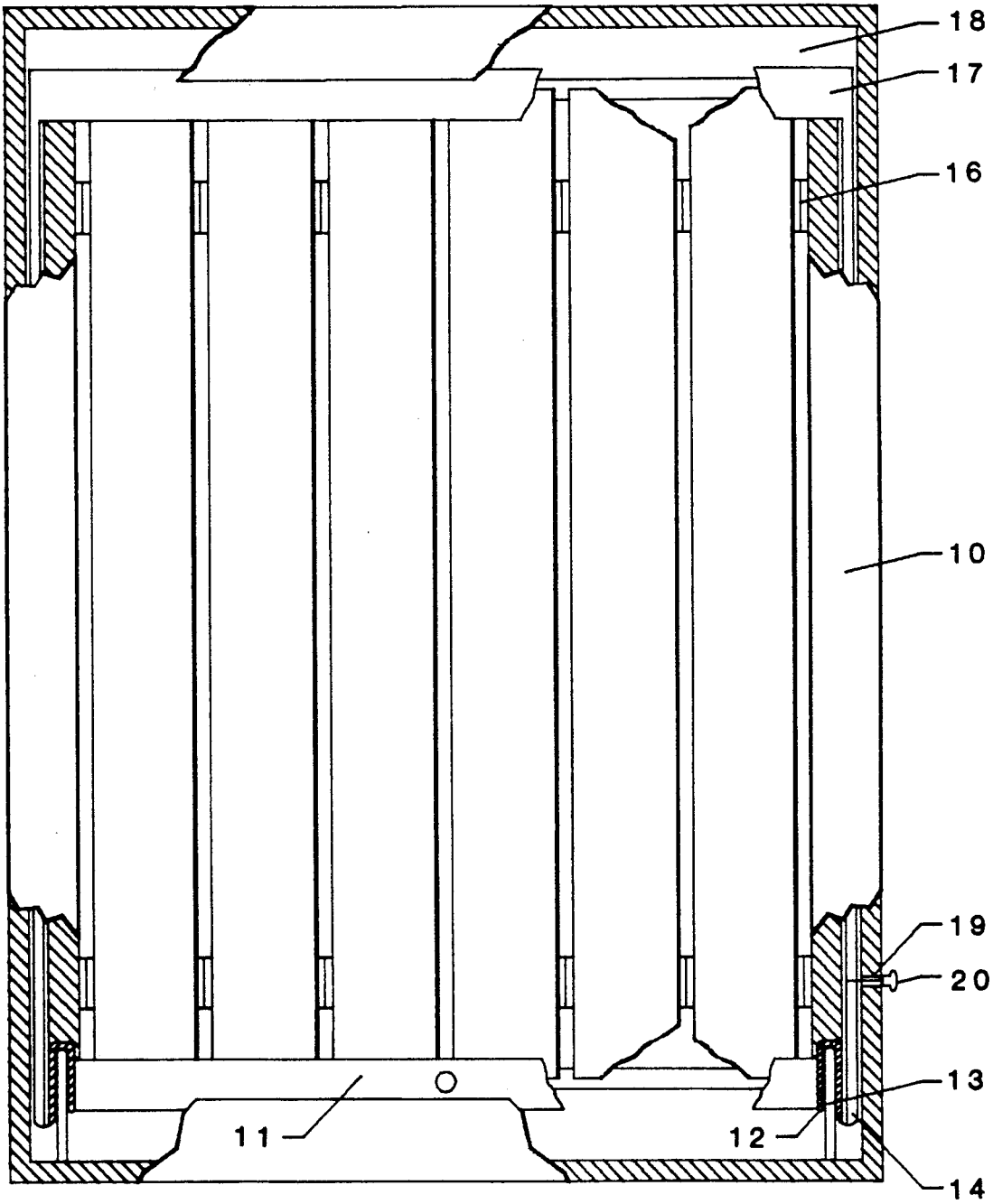
FIG. 8 is a face sectional view.

The locking system comprises of frame 10, which is slotted at the top and bottom, and along a small portion of the inside edge in the four corners 26. Within the bottom slotted space 23, is a horizontal member 11, which is fitted to slide within the slotted space and extend from one slotted corner of the opening into the opposing slotted corner 24. Attached to the bottom horizontal member, is a flexible strap 12, which is routed up over the smooth round end of a spacer block 13, and down the other side where is attaches to a narrow vertical member 14, which is fitted to slide in a narrow hollow vertical space 15, near the outer edges of the frame. These narrow vertical members extend up and attach to the ends of the top horizontal sliding member 17, which is fitted to slide within the slotted space in the top of the frame 18, and extend from one slotted corner in the top of the frame 24, and into the opposing corner. A pin 20, is placed through the side of the frame and into the vertical sliding member to cause an obstruction to prevent both horizontal sliding members 11 and 17, from being moved away from the shutters 21, by a potential intruder. Shutters 21, are vertical, hinged together 16, and hinged to the side of the locking frame. When shutters 21, are extended to close off the window opening, shutters shall rest against horizontal cross members called shutter stops 22, attached to the back of the shutter frame near the top and bottom and continuous from one side of the frame to the other side of the frame. The bottom horizontal sliding member 11, is raised by lifting the knob 23, attached to the center of it. As the bottom horizontal member is raised up over the bottom ends of the shutter slats 21, the flexible strap 12, attached to the ends of the bottom horizontal member 11, reacts by the weight of the bottom horizontal member 11, being lifted off the flexible straps 12, causing the flexible straps to slip up over the round end of the space element 13, at the same time, the weight of the top horizontal member 17, is pushing down on the small vertical sliding members 14, which are also pushing down on the flexible straps 12 attached to them, subsequently, when the top horizontal sliding member 17 drops, this simultaneously creates an obstruction in front of the shutters 21, which will prevent someone from the outside from pushing the shutters open. The shutters 20 in the closed position, will also be obstructed by the top and bottom fixed horizontal members 22 which will prevent someone from the outside from pulling the shutters outward. Subsequently, when the shutters 21 are closed, and locked, they cannot be pushed in or pulled out by someone on the outside. A pin 20, shall be inserted through a small hole 19, in the side of the frame, and through the narrow vertical sliding member 14, which causes an obstruction to all sliding parts.

The housing frame shall be securely fastened 26, to the window opening in known manner.

NUMBERED ELEMENTS

10. Frame for housing horizontal and vertical sliding element.

11. Bottom horizontal sliding member.
12. Flexible strap.
13. Spacer with round end.
14. Vertical sliding member.
15. Vertical hollow space.
16. Hinged elements.
17. Top horizontal sliding member.
18. Slotted space within the top of the housing frame.
19. Hole through frame and vertical sliding member.
20. Locking pin.
21. Shutter slats.
22. Top and bottom stops.
23. Knob for lifting bottom horizontal member.
24. Slotted space within the bottom of the frame housing.
25. Slotted space in the four inside corners of the frame.
26. Location for fasteners.

I claim:

1. A locking system for folding shutters comprising:

a. a plurality of vertically extending slats hingedly connected at their side edges to form a folding shutter;

b. horizontal top and bottom frame members having respective top and bottom stops and opposing vertical elongate side frame members extending between respective ends of said top and bottom frame members thereby defining a rigid first frame;

c. said top and bottom frame members having slotted spaces extending the length thereof; said side frame members having corresponding slotted spaces extending partially inwardly from their respective ends and further containing an enclosed channel extending the length thereof; a spacer block located at each of the lower corners of the first frame;

d. horizontal upper and lower sliding members and opposing vertical side sliding members extending between respective ends of said upper and lower sliding members thereby defining a second frame; said vertical members being rigidly attached at their upper ends to said upper sliding member and movably attached at their lower ends to said lower sliding member by flexible straps;

e. said second frame being located within said first frame whereby said upper and lower sliding members are located within the slotted spaces within respective top and bottom frame members; each of said vertical side sliding members are located within a respective enclosed vertical channel; the ends of said upper and lower sliding members are located adjacent said partially inwardly extending slotted spaces and are movable into said slotted spaces upon locking of the shutters; said flexible straps extend from the lower end of a respective said vertical side sliding member upwardly over a respective spacer block and downwardly to a respective end of said lower horizontal sliding member; and f. first and second locking apertures located in a vertical side frame member of said first frame and the corresponding vertical side sliding member of said second frame; and a locking pin; whereby g. when said slats are in a closed, unfolded position, said lower sliding member may be raised within said lower slotted space and within corresponding partially inwardly extending slotted spaces thereby urging said straps to transverse respective said spacer blocks, thereby urging said vertical side sliding members downwardly within said enclosed channels thereby urging said upper sliding member downwardly within said top slotted space and corresponding partially inwardly extending slotted spaces; whereby said upper and lower sliding members engage a first surface of respective upper and lower ends of said slats; a rear surface of respective upper and lower ends of said slats engaging said top and bottom stops, thereby maintaining the shutter in the closed position; and wherein said first and second apertures are aligned so that said locking pin is inserted in said aligned apertures, thereby locking said frame members together and hence locking said shutter.

* * * * *